US007836795B2

(12) United States Patent
Vatne

(10) Patent No.: US 7,836,795 B2
(45) Date of Patent: Nov. 23, 2010

(54) POWER TONG DEVICE

(75) Inventor: Per A. Vatne, Kristiansand (NO)

(73) Assignee: Wellquip AS, Kristiansand (NO)

( * ) Notice: Subject to any disclaimer, the term of this patent is extended or adjusted under 35 U.S.C. 154(b) by 167 days.

(21) Appl. No.: 11/917,386

(22) PCT Filed: Jun. 9, 2006

(86) PCT No.: PCT/NO2006/000220

§ 371 (c)(1),
(2), (4) Date: Feb. 14, 2008

(87) PCT Pub. No.: WO2006/135248

PCT Pub. Date: Dec. 21, 2006

(65) Prior Publication Data

US 2008/0257116 A1 Oct. 23, 2008

(30) Foreign Application Priority Data

Jun. 13, 2005 (NO) ..... 20052844

(51) Int. Cl.
*B25B 17/00* (2006.01)

(52) U.S. Cl. ..... 81/57.15; 81/57; 81/57.11; 81/57.16; 81/57.2

(58) Field of Classification Search ..... 81/57, 81/57.11, 57.15, 57.16, 57.2
See application file for complete search history.

(56) References Cited

U.S. PATENT DOCUMENTS 1,871,857 A * 8/1932 Martois ..... 81/57.16
3,799,009 A 3/1974 Guier
4,423,647 A 1/1984 Toelke
4,442,736 A * 4/1984 True et al. ..... 81/57.15
5,626,435 A * 5/1997 Wohlhuter ..... 403/348
7,281,451 B2 * 10/2007 Schulze Beckinghausen ..... 81/57.34
2005/0188794 A1 9/2005 Schulze-Beckinghausen

FOREIGN PATENT DOCUMENTS

EP 0339005 10/1989

OTHER PUBLICATIONS

Written Opinion, Sep. 27, 2006, No PCT Office.

* cited by examiner

*Primary Examiner*—Joseph J Hail, III
*Assistant Examiner*—Shantese McDonald
(74) *Attorney, Agent, or Firm*—Gable Gotwals

(57) ABSTRACT

A power tong (1) device, in which the power tong (1) includes two housing halves (2), pivotable relative to each other, the housing halves (2) being arranged to be pivoted between a closed, active position and an open, inactive position, and in which a radially divided drive ring (6, 8), which is provided with hydraulically activated clamping dies (14) directed towards the centre axis (10) of the power tong (1), is placed in the housing halves, the drive ring (6, 8) being supported and connected to a driving motor (12) for the rotation of the drive ring (6, 8) about said axis (10), the drive ring (6, 8) being provided with at least one locking means (16) which is arranged to interconnect the parts of the drive ring (6, 8) in a releasable manner.

9 Claims, 5 Drawing Sheets

III–III

III–III

IV-IV

POWER TONG DEVICE

This application is based on PCT Patent Application No. NO2006/000220, filed on Jun. 9, 2006, which is based on Norwegian Patent Application No. 20052844, filed on Jun. 13, 2005.

This invention relates to a power tong. More particularly it relates to a power tong, in which the power tong comprises two housing halves pivotable relative to each other, the housing halves being arranged to be pivoted between a closed, active position and an open, inactive position. A radially divided drive ring provided with hydraulically activated clamping dies directed towards the centre of the power tong is placed in the housing halves, the drive ring being supported and connected to a drive for the rotation of the drive ring about said centre axis. The drive ring is provided with at least one bayonet catch, which is arranged to connect the parts of the drive ring in a releasable manner.

In connection with drilling operations in the ground, in which joinable drill pipes are used, for example in the recovery of petroleum, mechanized pipe tongs in the form of power tongs are well known and extensively used.

Power tongs of this kind normally include hydraulically or mechanically activated grippers or clamping dies which are arranged to clamp a pipe grippingly.

It is common that power tongs either are provided with a radial opening or can be opened, so that the power tong can be moved in a radial direction onto and away from the pipe.

Due to the relatively great clamping forces that are necessary when pipes are being connected, open power tongs are often relatively heavy because they have to be sized to be able to absorb said forces. Closed power tongs, in which the clamping forces can be absorbed by a closed ring, are often relatively light, but it has turned out to be difficult to provide a closing mechanism for the power tong, which is both strong enough and which exhibits the necessary reliability.

The invention has as its object to remedy or reduce at least one of the drawbacks of the prior art.

The object is achieved in accordance with the invention through the features specified in the description below and in the subsequent Claims.

A power tong according to the invention includes two housing halves, pivotable relative to each other, the housing halves being arranged, preferably hydraulically, to be pivoted between a closed, active position and an open, inactive position. A radially divided drive ring, which is provided with hydraulically activated clamping dies directed towards the centre axis of the power tong, is placed in the housing halves, the drive ring being supported and connected to at least one driving motor for the rotation of the drive ring about the centre axis. The drive ring is provided with at least one locking means, typically in the form of a bayonet catch which is arranged to join the drive ring together in a releasable manner.

By way of mechanical transmissions the bayonet catch is preferably hydraulically rotatable between an active and a nonactive position. The part of the bayonet catch, which is located in a first drive ring part, includes a body provided with locking dogs. The body with the locking dogs fits complementarily into a recess in an opposite second drive ring part. By rotating the bolt about its centre axis the locking dogs may be moved between the active and the non-active position.

Advantageously the mechanical transmission of the bayonet catch includes an index pin located on one of the drive ring parts, the index pin, which is moved in the axial direction by a hydraulic piston in the corresponding housing half, cooperating with an eccentrically mounted pivot on the shaft.

As the drive ring parts are moved towards each others they will bear on each other along a radial abutment guide list which is placed at one end surface of the drive ring carts, typically the upper end surface. The drive ring parts are moved further towards each other so that the drive ring parts are rotated relative to each other over a relatively small angle about the guide lists. The bayonet catch can be opened and closed while the drive ring parts are in these relative positions.

With the bayonet catch in its locked position the drive ring parts align relative to each other as the clamping dies tighten against a pipe. The bayonet catch is thereby tightened. To lock the first and the second drive ring parts within their respective housing halves, the index pin is, when the bayonet catch is in its inactive position, in a recess in its corresponding housing half. Thereby, it is not possible for the drive ring parts to become displaced in the housing halves when the bayonet catch is open.

By the connection of the drive ring parts by means of a pre-loaded bayonet catch according to the inventions the drive ring parts will exhibit, in their connected and tightened position, a substantially improved rigidity relative to known divided drive rings.

In what follows is described a non-limiting example of a preferred embodiment which is visualized in the accompanying is drawings, in which.

Figure 1:
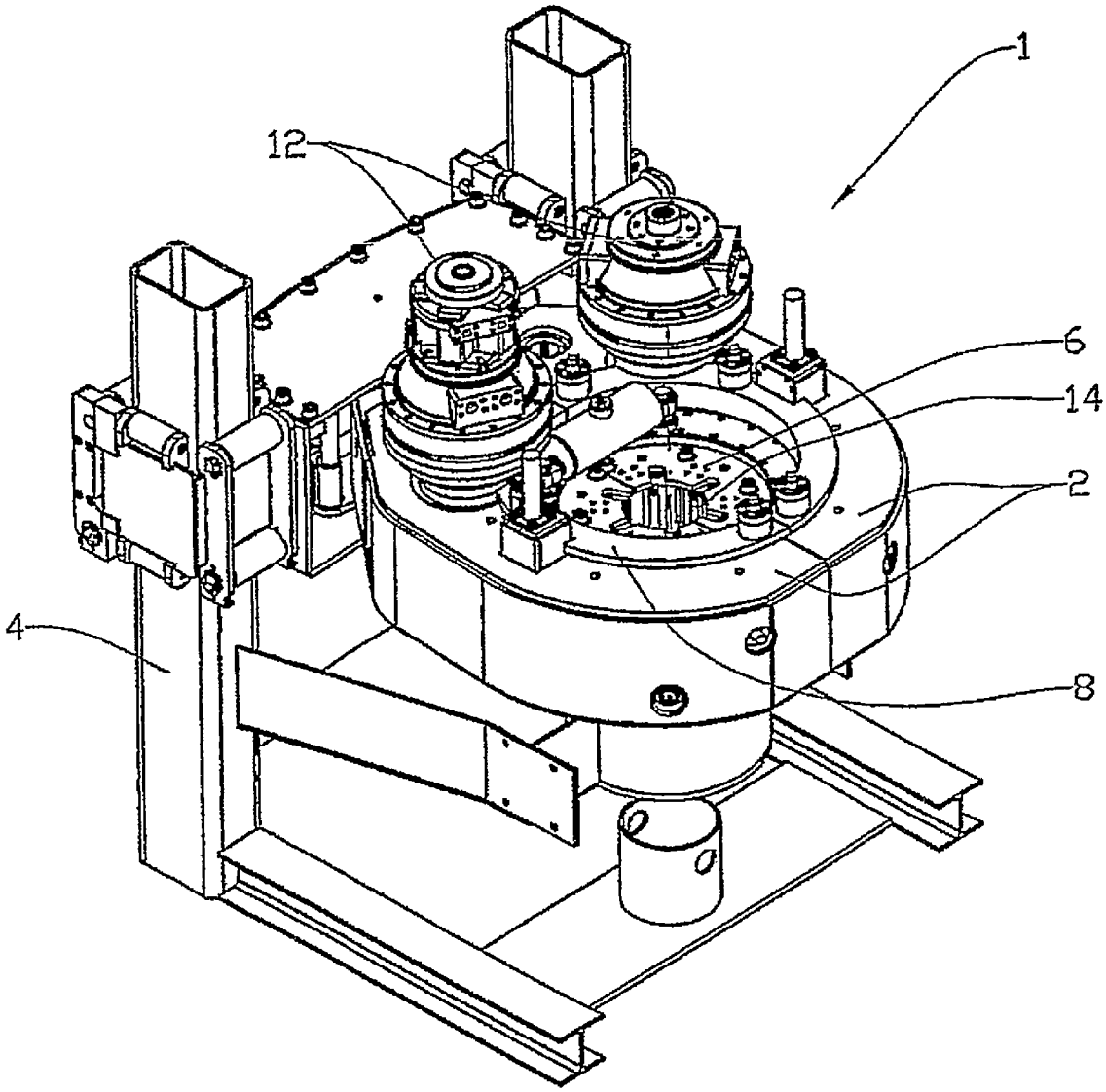
FIG. 1 shows a power tong according to the invention.

In the drawings the reference numeral 1 denotes a power tong, s which includes two housing halves 2, movable relative to each other and connected, jointly liftable and lowerable, to a support 4 in a manner known per se.

A two-part drive ring includes a first drive ring part 6 and a second drive ring part 8 which can be interconnected into a drive ring, and which are arranged to be rotated about their own centre axis 10 by means of driving motors 12 when the housing halves 2 are in their closed, active position, see FIG. 1.

A number of clamping dies 14 which are located in the drive ring parts 6 and 8 are radially movable and arranged to grip about a pipe (not shown).

The drive ring parts 6, 8 may be releasably connected to each other by means of two bayonet catches 16.

Figure 2:
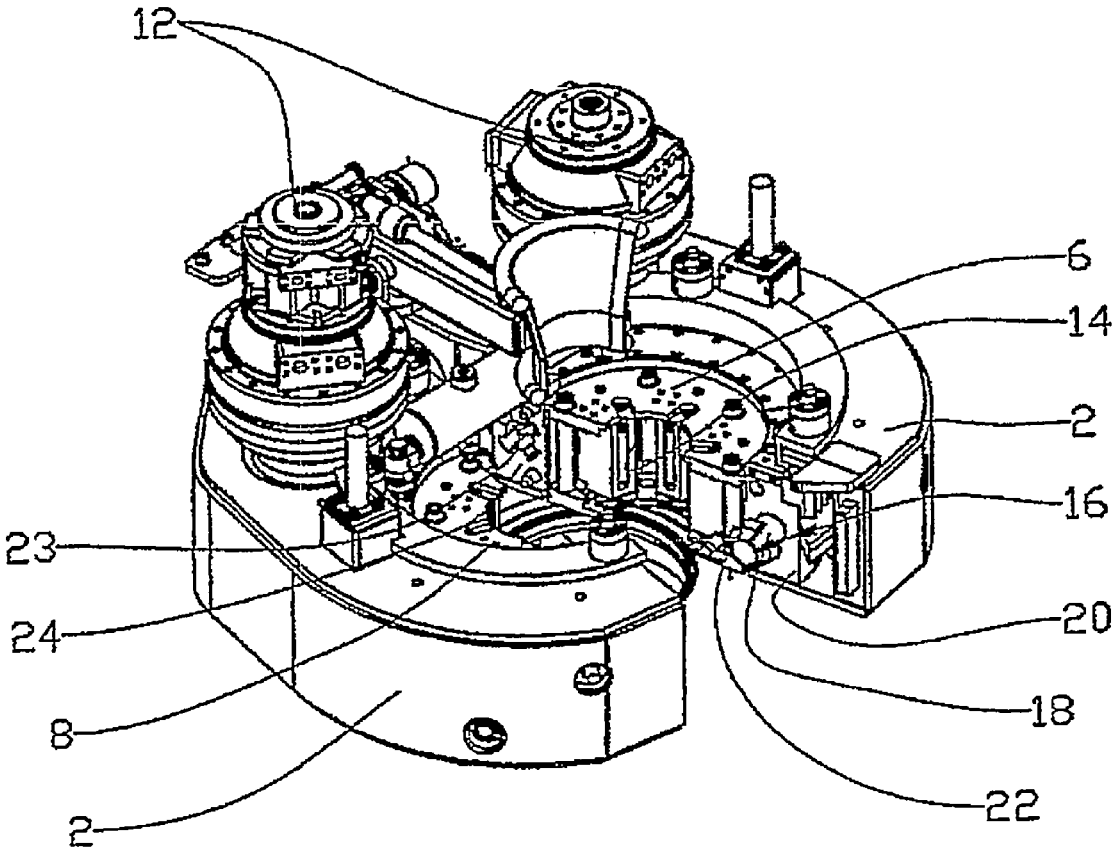
FIG. 2 shows the housing halves of the power tong in an open position.
Figure 3:
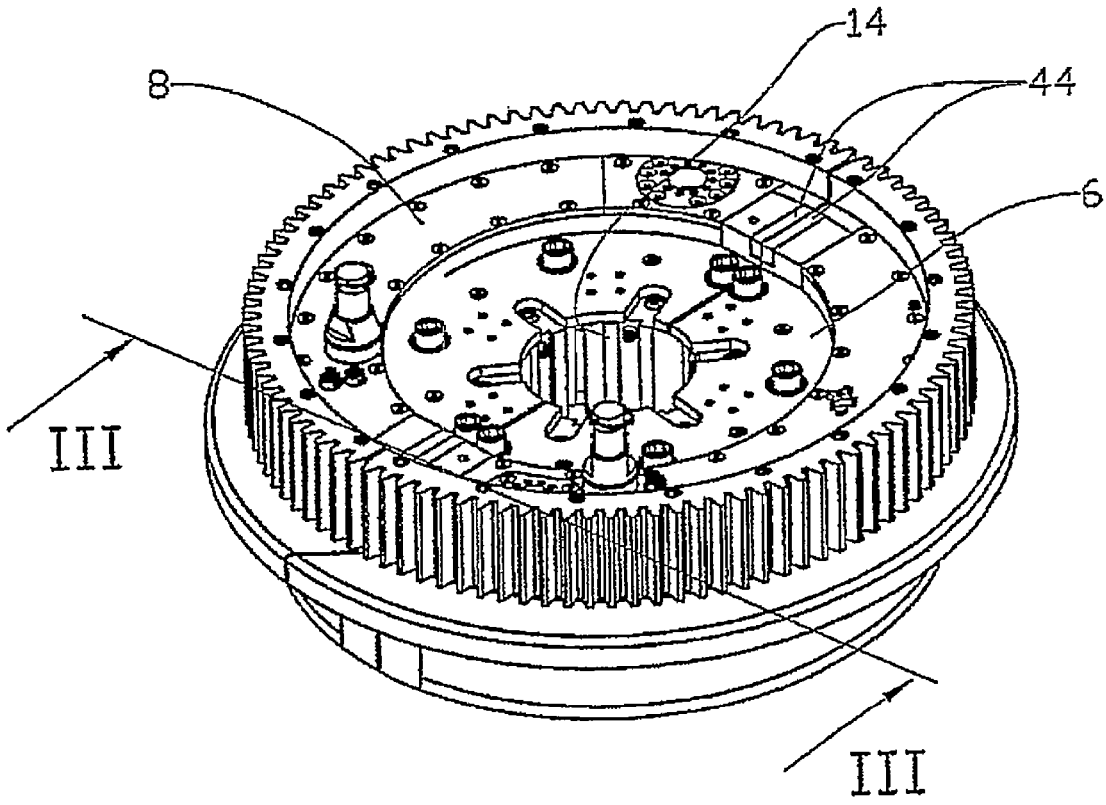
FIG. 3 shows, on a larger scale, a drive ring.
Figure 4:
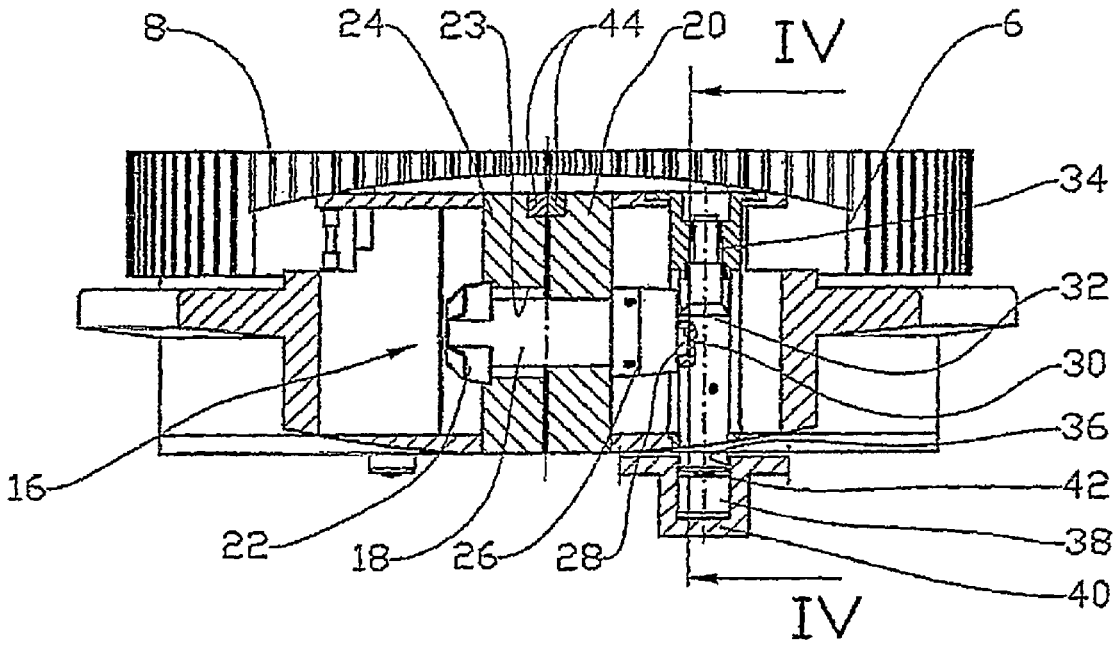
FIG. 4 shows a section III-III of FIG. 3.
Figure 5:
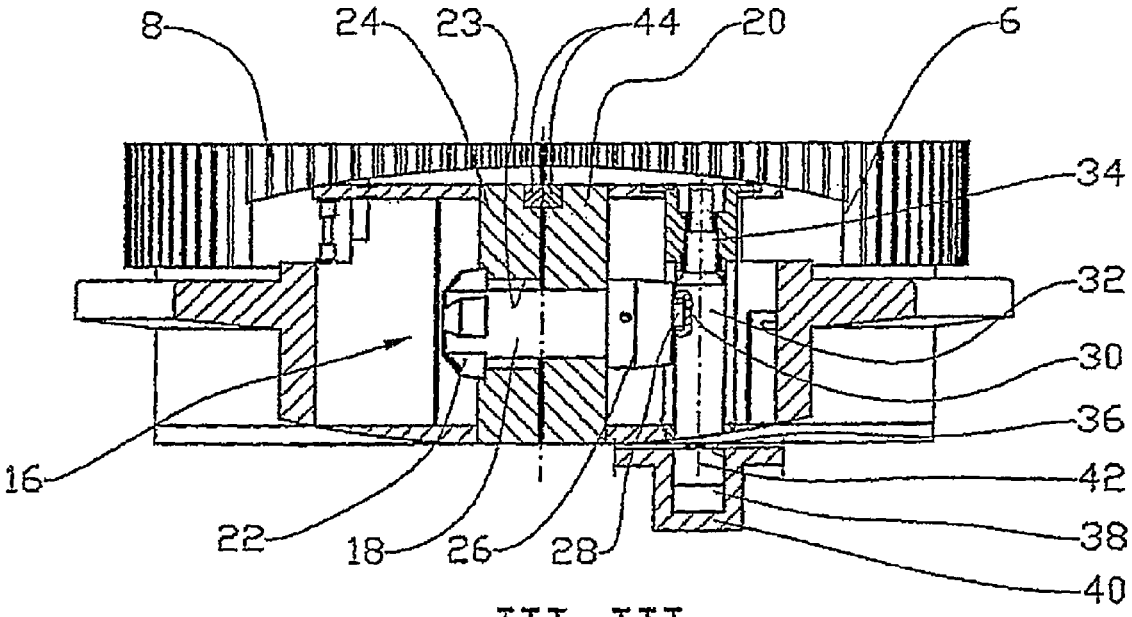
FIG. 5 shows the same section as FIG. 4, but here the bayonet catch is in its locked, active position.
Figure 6:
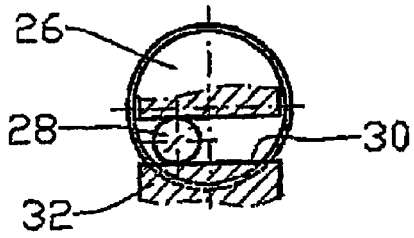
FIG. 6 shows, on a further enlarged scale, a view IV-IV of FIG. 4.

Each of the bayonet catches 16 includes a body 18 in the form of an axle extending in a tangential direction relative to its respective drive ring parts 6, 8, and extending through and out of a first connecting plate 20 of the drive ring part 6, 8 and towards the adjacent connection halves 6, 8. The axle 18 is rotatable about its own longitudinal axis and is provided with locking dogs 22 at its free end portion, see FIGS. 2, 4 and 5.

The axle 18 and the locking dogs 22 fit complementarily into a recess 23 in a second connecting plate 24 of the adjacent drive ring half 6, 8. A lock bushing 26 prevents the axle 18 from being moved out in the axial direction relative to the first connecting plate 20. The axle 18, locking dogs 22 and lock bushing 26 constitute the locking body of the bayonet catch 16.

The lock bushing 26 is provided with an eccentrically placed. pivot 28 positioned in an elongated transversal groove 30 in an index pin 32. The index pin 32 is axially movable and arranged to take up a first position, in which the bayonet catch 16 is in a non-active free position, see FIG. 4, and a second position, in which the bayonet catch 16 has been rotated into an active, locking position, see FIG. 5.

The index pin 32 which is spring-loaded in the direction of its first position by means of a spring 34, extends when it is in this first position, into a piston recess 36 in its corresponding housing half 2.

A piston 38 extending in a cylinder 40 in the extension of 2D the piston recess 36, is arranged to move the index pin 32 to its second position, in which the index pin 32 is disengaged from the piston recess 36 and thereby is free to rotate about the centre axis 10 of the power tong together with the drive ring 6, 8.

At its end portion facing the piston recess 36, the index pin 32 is provided with a wheel 42, which is arranged to roll on the piston 38 and housing halves 2.

At their abutting faces the drive ring parts 6 and 8 are provided with radial guide lists 44, The guide lists 44 are at the upper side of the drive ring parts 6, 8. When the drive ring parts 6, 8 bear on each other at their respective guide lists 44, the first connecting plate 20 has some clearance to the corresponding second connecting plate 24.

Figure 7:
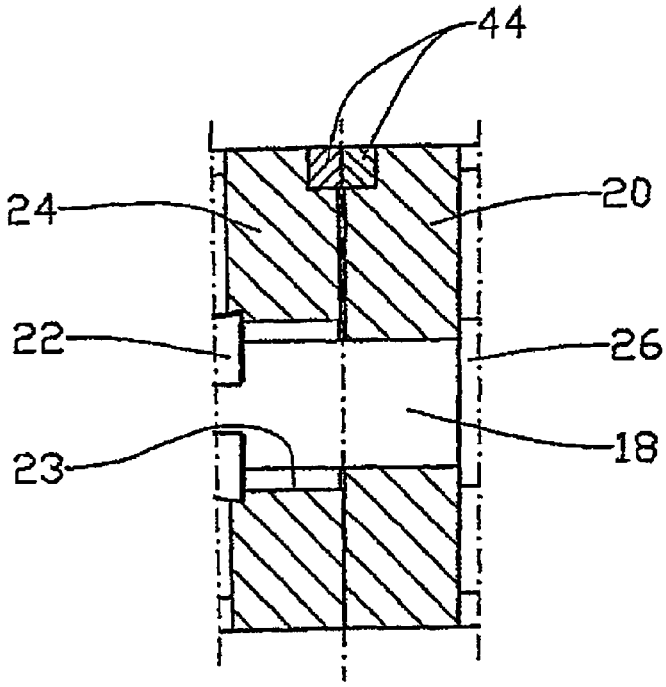
FIG. 7 shows, on a further enlarged scale, the relative positions or the drive ring parts during connection and disconnection of the bayonet catch.

By moving the drive ring parts 6, 8 further together, the respective drive ring parts 6, 8 are rotated about their respective guide lists 44 until the adjacent connecting plates 20, 24 meet, see FIG. 7. While the drive ring parts 6, 8 are in this position, the axle 18 can freely be rotated between the locked and free positions.

The bayonet catch 16 is. tightened in its locked position by the tightening of the clamping dies 14 against the pipe (not shown).

Due to the engagement of the index pin 32 in the piston recess 36 the respective drive ring parts 6, 8 are prevented from being rotated out of their respective housing halves 2 while the housing halves are in their open position. The housing. halves 2 are prevented from being rotated from their closed position until the drive ring parts. 6, 8 are locked within their respective housing halves 2.

The invention claimed is:

1. A power tong comprising:

two housing halves pivotable relative to each other, said housing halves being arranged to be pivoted between a closed, active position and an open, inactive position; and a radially divided drive ring having a first and a second drive ring part, one or more bayonet catches and a plurality of hydraulically activated clamping dies directed towards a centre axis of said power tong, said drive ring is located in said housing halves, said drive ring being supported and connected to a driving motor for the rotation of said drive ring about said centre axis, said drive ring and a locking means arranged to interconnect said first and second drive ring parts in a releasable manner;

wherein, each said bayonet catch has a locking body hydraulically rotatable between an active and a non-active position.

2. The power tong in accordance with claim 1, said locking body comprising at least one locking dog, said locking body and said locking dog being located on one of said first and second drive ring parts and fitting complementarily into a recess in the opposite drive ring part, a rotation of said locking body about a centre axis moving said locking dog between the active and the non-active position.

3. The power tong in accordance with claim 2, further comprising said bayonet catch being rotatable by a movable index pin located in said drive ring, said index pin cooperating with an eccentrically mounted pivot on said locking body.

4. The power tong in accordance with claim 3, further comprising said index pin being movable by a corresponding hydraulic cylinder located in one of said housing halves.

5. The power tong in accordance with claim 3, further comprising said bayonet catch being in the inactive position and said index pin being moved into a piston recess in one of said first and second housing halves.

6. The power tong in accordance with claim 1 further comprising said first drive ring part and said second drive ring part each having a radial guide list and said drive ring parts bearing on each other along said radial guide lists, said first and second drive ring parts being arranged to be rotated about said guide lists in order to relieve said bayonet catch.

7. A method for handling oilfield pipe comprising the steps of:

positioning a drive ring about a pipe, said drive ring having two pivotally connected, radial drive ring halves and a plurality of clamping dies, said drive ring halves being in an open, inactive position about the pipe;

rotating said drive ring halves to a closed, active position about the pipe;

locking said two drive ring halves in said closed, active position by rotating a locking body about a centre axis, said locking body having a locking dog and being connected to one of said two drive halves and inserting said locking dog into a complementary recess located in said opposite drive ring half;

activating said clamping dies to grip a surface of the pipe;

wherein said rotating step is accomplished by a movable index pin located in said drive ring and in communication with an eccentrically mounted pivot on said locking body.

8. The method of claim 7 wherein said rotating step is accomplished by a hydraulic cylinder located in said drive half.

9. A method for handling oilfield pipe comprising the steps of:

positioning a drive ring about a pipe, said drive ring having two pivotally connected, radial drive ring halves and a plurality of clamping dies, said drive ring halves being in an open, inactive position about the pipe;

rotating said drive ring halves to a closed, active position about the pipe;

locking said two drive ring halves in said closed, active position;

activating said clamping dies to grip a surface of the pipe;

deactivating said clamping dies;

releasing said two drive ring halves from said locked position; and rotating said drive ring so that said drive ring halves pivot to an open, inactive position about the pipe wherein said releasing step is comprising moving an index pin into a piston recess located in said corresponding drive ring half.

* * * * *